US011001995B2

(12) United States Patent
Mastellotto

(10) Patent No.: US 11,001,995 B2
(45) Date of Patent: May 11, 2021

(54) LAVATORY WITH HIDDEN DRAIN

(71) Applicant: Kohler Co., Kohler, WI (US)

(72) Inventor: Cristian Mastellotto, Damparis (FR)

(73) Assignee: KOHLER CO., Kohler, WI (US)

( * ) Notice: Subject to any disclaimer, the term of this patent is extended or adjusted under 35 U.S.C. 154(b) by 1 day.

(21) Appl. No.: 16/392,249

(22) Filed: Apr. 23, 2019

(65) Prior Publication Data

US 2019/0345702 A1 Nov. 14, 2019

Related U.S. Application Data

(60) Provisional application No. 62/662,336, filed on Apr. 25, 2018.

(51) Int. Cl.
*E03C 1/22* (2006.01)
*E03C 1/182* (2006.01)

(52) U.S. Cl.
CPC ..... *E03C 1/22* (2013.01); *E03C 1/182* (2013.01)

(58) Field of Classification Search
CPC ... E03C 1/14; E03C 1/18; E03C 1/182; E03C 1/22; E03C 1/2302; E03C 1/232; E03C 1/24; E04H 4/1227
See application file for complete search history.

(56) References Cited

U.S. PATENT DOCUMENTS 1,195,684 A 8/1916 Kelly
1,784,641 A * 12/1930 Oldfield ..... E03C 1/23 4/651
2,767,407 A * 10/1956 Weiss ..... E03C 1/23 4/653
4,765,002 A 8/1988 Platner
4,777,676 A * 10/1988 Ericson ..... E03C 1/14 4/286
6,618,874 B2 9/2003 Gerloff
7,941,878 B1 * 5/2011 Truong ..... E03C 1/122 4/685
9,009,882 B2 4/2015 Bucher
10,190,296 B2 * 1/2019 McKendrick ..... E03C 1/14
(Continued)

FOREIGN PATENT DOCUMENTS

BR PI0 605 437 7/2008
BR PI0605437 A 7/2008
CN 105113583 A 12/2015
(Continued)

OTHER PUBLICATIONS

Partial European Search Report re Application No. 19170591.2 dated Sep. 19, 2019.
(Continued)

*Primary Examiner* — David P Angwin
*Assistant Examiner* — Nicholas A Ros
(74) *Attorney, Agent, or Firm* — Foley & Lardner LLP

(57) ABSTRACT

A lavatory includes a basin including a bottom surface, the basin configured to hold a volume of water; and a drain opening disposed in the bottom surface of the basin. The bottom surface of the basin includes a substantially horizontally extending projection formed integrally with the bottom surface of the basin. The horizontally extending projection is disposed over the drain opening such that the drain opening is at least partially obscured from a view of a user.

18 Claims, 14 Drawing Sheets

(56) References Cited

U.S. PATENT DOCUMENTS

| | | | | |
|---|---|---|---|---|
| 2007/0130687 | A1* | 6/2007 | Sadler | E03C 1/232<br>4/671 |
| 2020/0002926 | A1* | 1/2020 | Loberger | E03C 1/057 |

FOREIGN PATENT DOCUMENTS

| | | | | |
|---|---|---|---|---|
| DE | 102004012994 | * | 10/2004 | A47K 1/04 |
| EP | 1367185 | * | 12/2003 | E03C 1/18 |

OTHER PUBLICATIONS

Foreign Action other than Search Report on non-Foley case related to U.S. Appl. No. 16/392,249 dated May 6, 2020.
Extended European Search Report for EP Appl. Ser. No. 20180561.1 dated Sep. 23, 2020 (8 pages).

* cited by examiner

LAVATORY WITH HIDDEN DRAIN

CROSS-REFERENCE TO RELATED APPLICATION

This application claims the benefit of and priority to U.S. Provisional Patent Application No. 62/662,336, filed Apr. 25, 2018, the entire disclosure of which is incorporated by reference herein.

BACKGROUND

The present application generally relates to the field of lavatories (e.g., sinks, etc.). Specifically, the present application relates to a lavatory having a hidden drain.

A lavatory may include a basin and a primary drain opening configured to receive a flow of water from the basin and thereby drain the water from the basin. The primary drain opening is configured to prevent water from accumulating in the basin. However, primary drain openings are often visible to users of the lavatory, thereby decreasing the aesthetic appearance of the user while the user uses the lavatory because foreign matter can collect at or around the primary drain opening. Accordingly, typical lavatories must be regularly cleaned to maintain the aesthetic appearance of the lavatory.

Additionally, a lavatory may have a secondary drain opening located on a side of the basin of the lavatory. The secondary drain opening is configured to receive a water flow from the basin when the primary drain opening of the basin is blocked or clogged. Accordingly, the secondary drain opening is configured to maintain the water level in the basin at or below a predetermined level when the primary drain opening is blocked or clogged. Because the secondary drain opening is typically located on a side of the basin, the secondary drain opening creates difficult to clean areas on the side of the basin such that foreign matter can collect at or around the secondary opening, decreasing both the aesthetic appearance of the basin and the cleanliness of the basin. Additionally, because additional piping is required to connect the secondary drain opening to a plumbing system, the secondary drain opening reduces the amount of potential storage space beneath the lavatory.

SUMMARY

According to a first exemplary embodiment, a lavatory includes a basin including a bottom surface, the basin configured to hold a volume of water; and a drain opening disposed in the bottom surface of the basin. The bottom surface of the basin comprises a substantially horizontally extending projection formed integrally with the bottom surface of the basin. The horizontally extending projection is disposed over the drain opening such that the drain opening is at least partially obscured from a view of a user.

According to one aspect, the drain opening is disposed in a middle portion of the bottom surface of the basin.

According to another aspect, the basin further comprises a chamber disposed beneath and in fluid communication with the drain opening. The chamber is configured to receive a first fluid flow from the drain opening and provide a second fluid flow to a waste.

According to another aspect, the chamber is configured to house at least a portion of an overflow pipe, the overflow pipe in fluid communication with the waste.

According to a second exemplary embodiment, a lavatory system includes a basin configured to hold a volume of water, the basin including a bottom surface; and a drain opening disposed in the bottom surface of the basin; and a hidden chamber disposed beneath the basin. The hidden chamber includes a fluid inlet and a fluid outlet and is configured to receive a fluid flow from the drain opening of the basin; and a drain assembly including an overflow pipe including a first end and a second end, the overflow pipe being moveable from a first position to a second position; and a waste in fluid communication with the fluid outlet of the hidden chamber. In the first position of the overflow pipe, fluid flows from the hidden chamber into the waste without flowing through the pipe and in the second position of the overflow pipe, fluid flow flows from the hidden chamber into the waste via the overflow pipe.

According to one aspect, the basin is configured to hold a volume of water when the overflow pipe is in the second position.

According to another aspect, the bottom surface of the basin comprises a horizontally extending projection formed integrally with the bottom surface of the basin. The horizontally extending projection is disposed over the drain such that the drain opening is at least partially obscured from a view of a user.

According to another aspect, the first end of the overflow pipe is housed within the hidden chamber.

According to another aspect, the lavatory system also includes a connecting rod connected to the overflow pipe and extending at least partially from the second end of the overflow pipe.

According to another aspect, the lavatory system also includes a pop-up rod assembly connected to the connecting rod, the pop-up rod assembly being configured to control a movement of the overflow pipe from the first position to the second position.

According to another aspect, the drain assembly also includes a first connector configured to be fluidly sealed to the fluid outlet of the hidden chamber.

According to another aspect, the drain assembly also includes a second connector configured to be fluidly sealed to the first connector and further configured to be connected to the waste.

According to a third exemplary embodiment, a drain assembly for a lavatory includes a pipe configured to receive a fluid flow, the pipe being moveable from a first position to a second position; a first connector comprising a first end portion including an inner diameter and a second end portion including an inner diameter and an outer diameter; and a second connector including a first end portion comprising an inner diameter configured to fit over and around the outer diameter of the second end portion of the first connector and a second end portion configured to be connected to a first waste. The first end portion of the first connector is configured to be connected to a fluid outlet of the lavatory. In the first position an end of the pipe is configured to be housed within an inner surface of the first connector and in the second position the end of the pipe is configured to be housed within an inner surface of the second connector.

According to one aspect, in the first position of the pipe, the drain assembly is configured to allow a fluid flow from a drain opening of the lavatory into the first waste without flowing through the pipe. In the second position, the drain assembly is configured to allow a fluid flow from the drain opening of the lavatory into the first waste via the pipe.

According to another aspect, the outer diameter of the second portion of the first connector includes a thread and the inner diameter of the first end portion of the second connector includes a thread configured to mate with the thread of the outer diameter of the second portion of the first connector.

According to another aspect, the drain assembly for a lavatory also includes a second waste configured to be housed within an inner surface of the second connector.

According to another aspect, the pipe includes a connecting rod connected to the pipe, the connecting rod being configured to be connected to a pop-up rod assembly of the lavatory.

According to another aspect, the pop-up rod assembly of the lavatory is configured to control a movement of the pipe between the first position and the second position.

According to another aspect, the end of the pipe is configured to be housed in a chamber of the lavatory.

According to another aspect, the first waste is connectable to an external plumbing system.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing.

FIGS. 13A-D illustrate an assembly process of the drainage assembly shown in FIG. 11, in which FIG. 13A illustrates the attachment of the first connector of the drainage assembly to a chamber of a lavatory system; FIGS. 13B and 13C illustrate the partial assembly of various components of the drainage assembly; and FIG. 13D illustrates the completed, assembled drainage assembly shown in FIG. 11 that is defined upon the attachment of the partially assembled drainage assembly shown in FIG. 13C to the first connector shown in FIG. 13A.

DETAILED DESCRIPTION

Referring generally to the figures, disclosed herein are lavatories and drain assemblies useable with a lavatory. These lavatories and drain assemblies are useable for providing an aesthetically pleasing lavatory by at least partially obscuring a drain opening and drain assembly from a user of the lavatory. Additionally, the lavatories and drain assemblies useable with a lavatory herein disclosed provide minimal difficult-to-clean areas in a lavatory basin.

Figure 1:
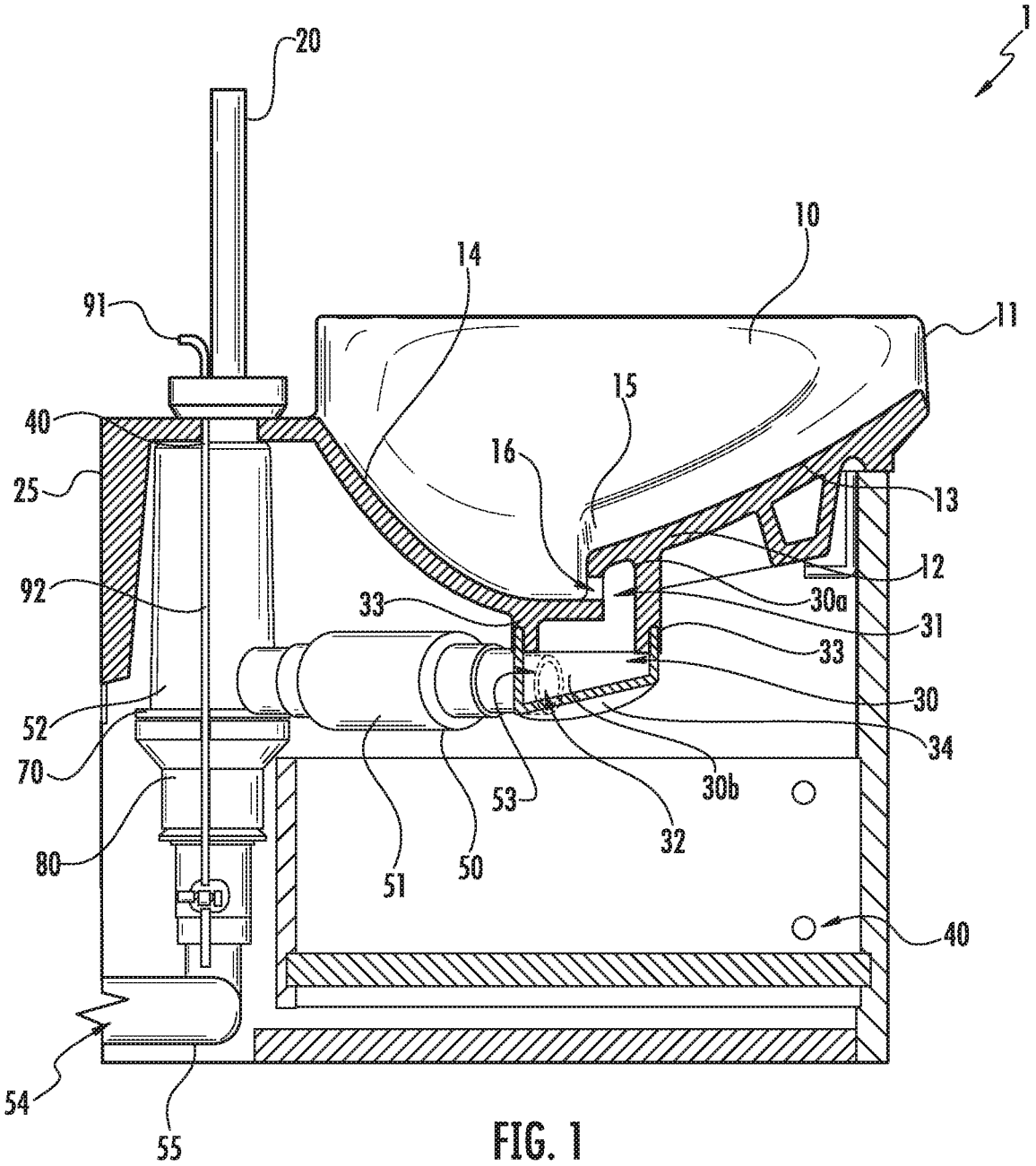
FIG. 1 is a side partial cross-sectional view of a lavatory system, according to a first exemplary embodiment.
Figure 2:
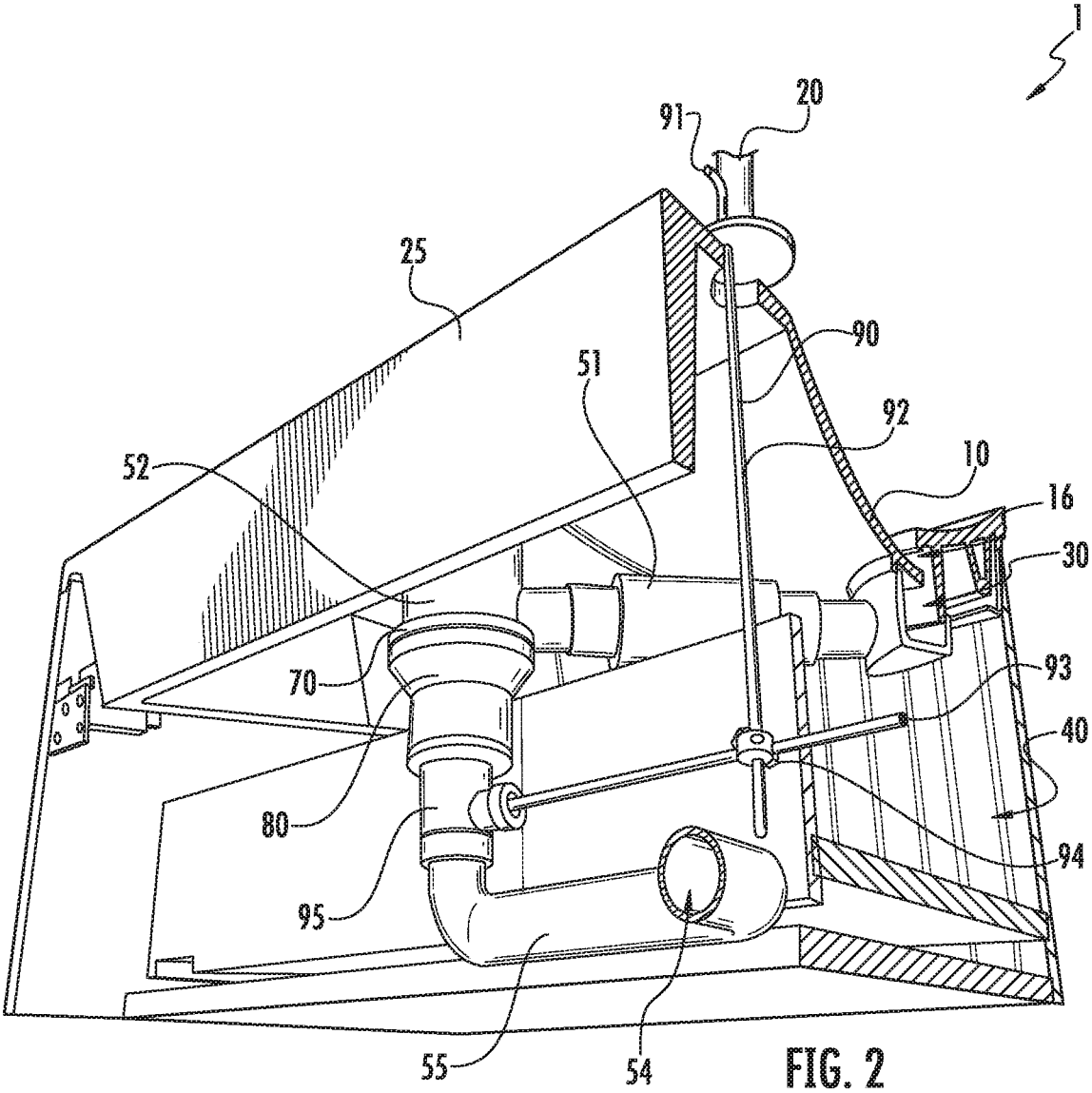
FIG. 2 is a rear perspective partial cross-sectional view of the lavatory system shown in FIG. 1.
Figure 3:
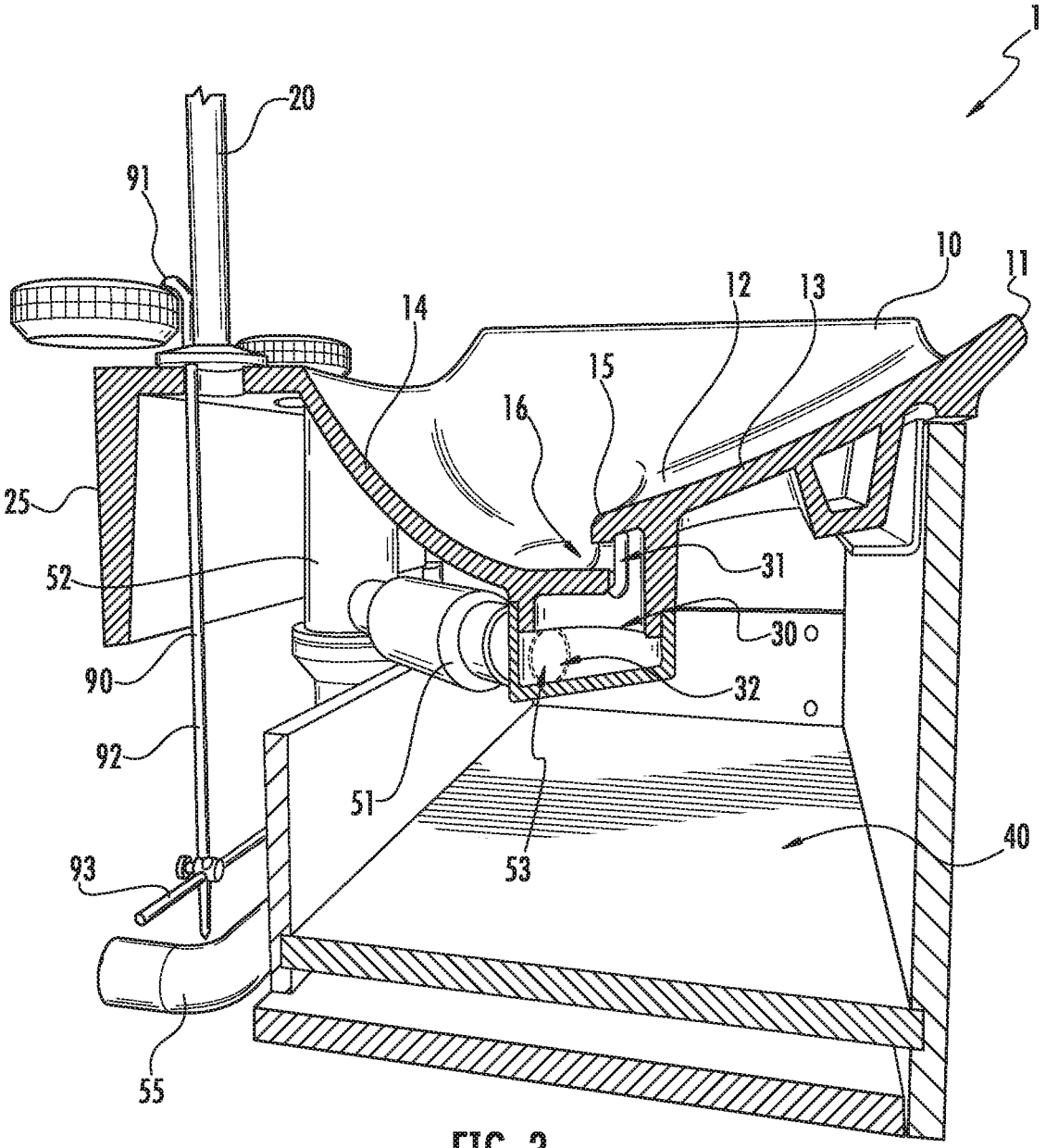
FIG. 3 is side perspective partial cross-sectional view of the lavatory system shown in FIG. 1.

Referring to FIGS. 1-3, a lavatory system 1 is shown according to an exemplary embodiment. The lavatory system 1 includes a basin 10 and a chamber 30 (e.g., hidden chamber) configured to be in fluid communication with the basin 10. The lavatory system 1 also includes a drain assembly 50 configured to be in fluid communication with the chamber 30 and further configured to be connectable to an external plumbing system. The configuration of the basin 10 and chamber 30 allows for a storage area 40 disposed beneath the basin 10.

Figure 4:
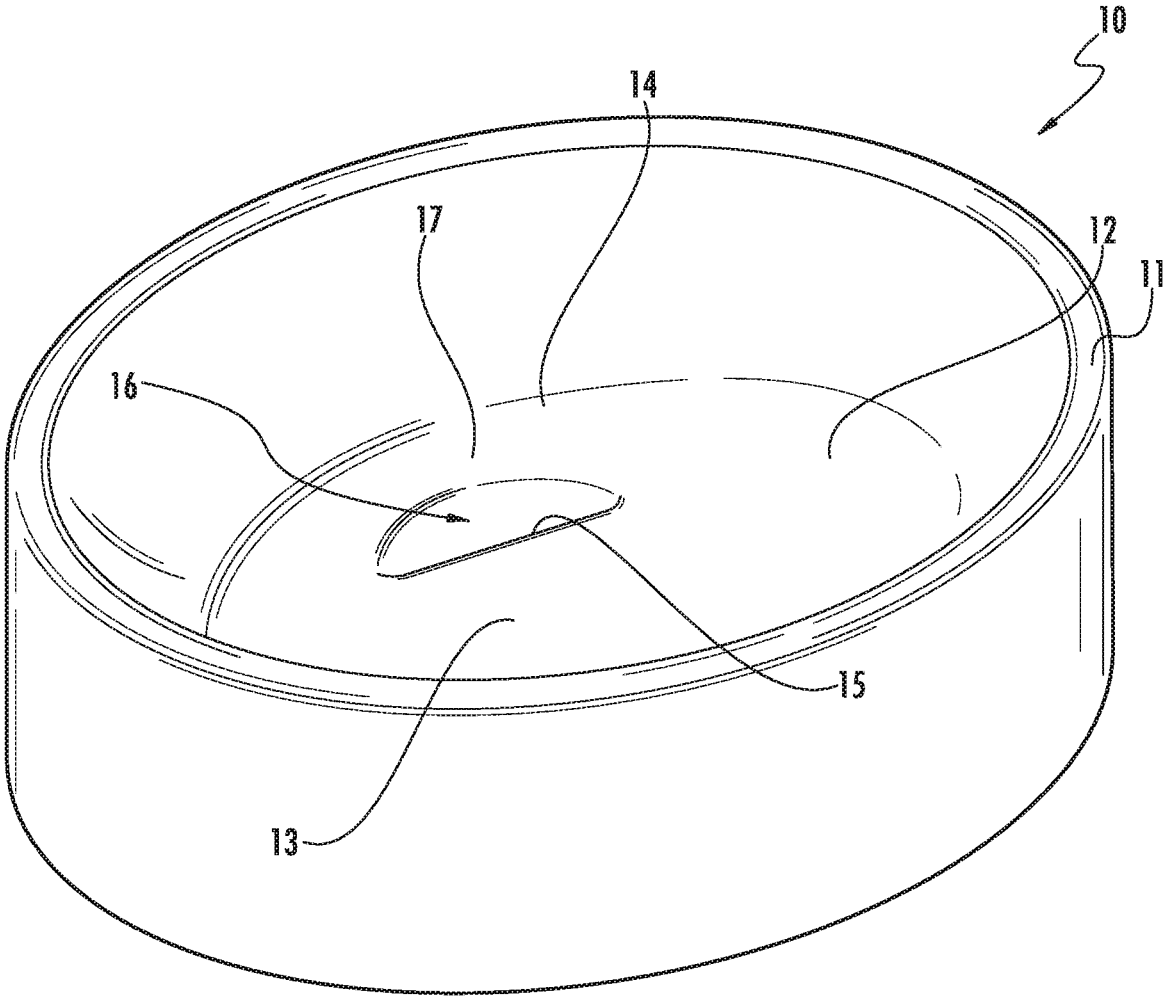
FIG. 4 is a front perspective view of a basin of the lavatory system shown in FIG. 1.
Figure 5:
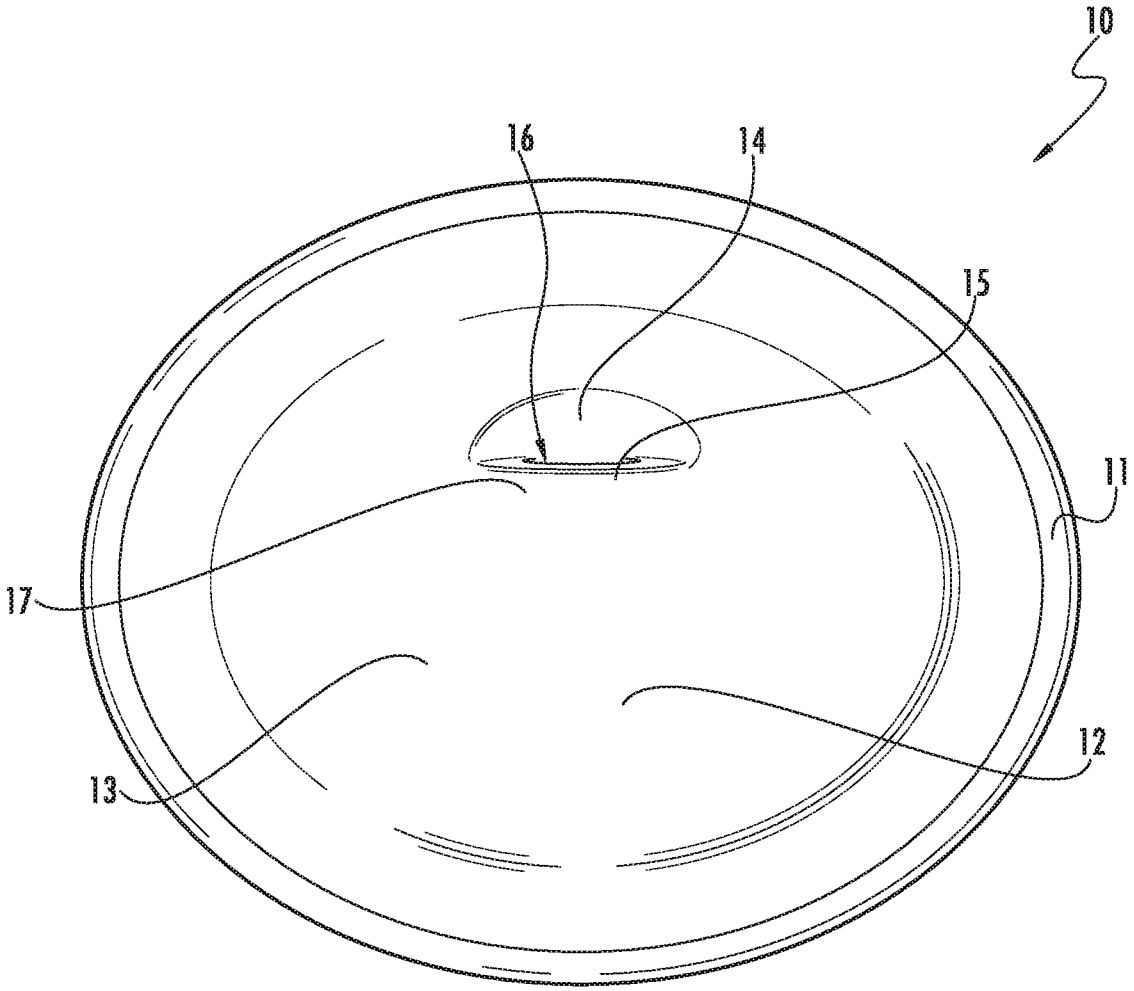
FIG. 5 is a top view of the basin shown in FIG. 4.
Figure 6:
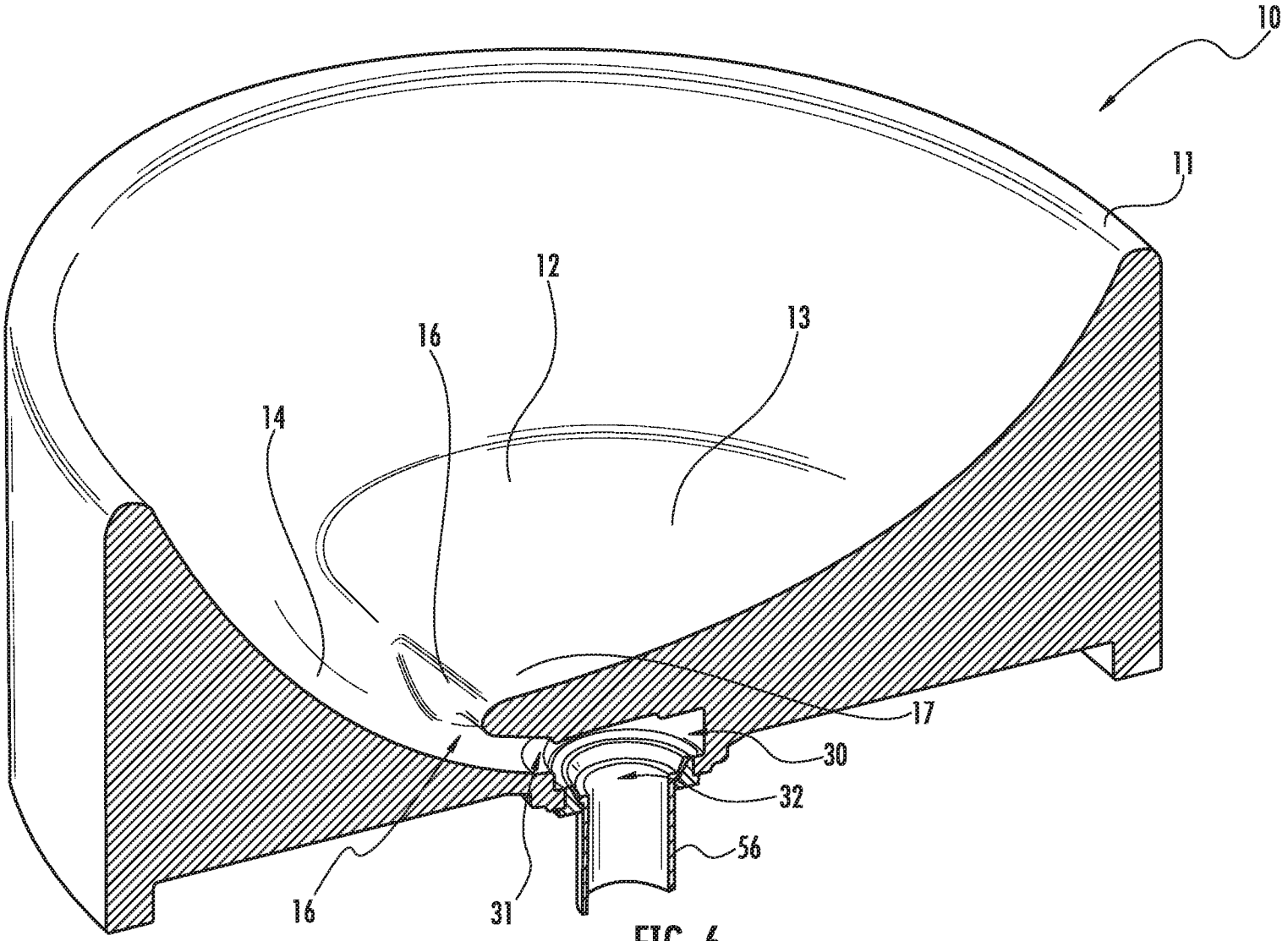
FIG. 6 is a side perspective cross-sectional view of the basin shown in FIG. 4.

As shown in FIGS. 1-3, the basin 10 is configured to receive a fluid flow (such as a flow of water) from a fluid source, such as a faucet (not shown) connected to a faucet neck 20. The basin 10 is also configured to hold a volume of fluid within the basin 10. The basin 10 is formed of any suitable material, for example, a ceramic material. As shown in FIGS. 1-6, the basin 10 includes a basin side wall 11 and a bottom surface 12. The bottom surface 12 includes a first portion 13 and a second portion 14. The first portion 13 and the second portion 14 of the bottom surface 12 define a drain opening 16. Although the shape of the basin 10 as shown in FIGS. 4-6 has a substantially elliptical horizontal cross-section, the shape of the basin 10 is not particularly limited to this implementation. The shape of the basin 10 may be any suitable shape such that the basin 10 is configured to hold a volume of fluid. For example, the basin 10 can have a rectangular horizontal cross-section such that the basin side wall 11 includes a front wall, a back wall, a left side wall, and a right side wall. The basin 10 is connected to basin support 25, which is configured to support the basin 10, either independently or dependently (e.g., by anchoring the basin support 25 to a wall).

As shown in FIGS. 4-6, a projection (e.g., horizontally extending projection, lip, etc.) 15 is formed integrally with the bottom surface 12. According to one aspect, the projection 15 is formed integrally with the first portion 13 of the bottom surface 12 of the basin 10. According to another aspect, the projection 15 extends substantially horizontally from the bottom surface 12 of the basin (for example, from the first portion 13 of the bottom surface 12). The projection 15 is disposed over and/or above the drain opening 16 of the basin 10. The projection 15 is configured to at least partially obscure from a view of a user the drain opening 16 of the basin 10. According to one aspect, the projection 15 is configured to completely obscure from the view of the user the drain opening 16 of the basin 10. Although the projection 15 is shown in FIGS. 4-6 as positioned in middle portion 17 of the bottom surface 12 of the basin 10, the present disclosure is not limited to this particular implementation. For example, the projection 15 can be positioned along a side wall 11 of the basin 10, for example, a front wall, a back wall, a left side wall, or a right side wall of the basin 10.

Referring back to FIGS. 1-3, the chamber 30 includes a fluid inlet 31 fluidly coupled with the drain opening 16 of the basin 10 and a fluid outlet 32 fluidly coupled to a channel 50 (as described in more detail below). The chamber 30 is defined by side walls 33 and a bottom wall 34. According to one aspect, the chamber 30 includes a first chamber portion 30*a* and a second chamber portion 30*b*. The first chamber portion 30*a* is defined by side walls 33, a bottom side of at least part of the first portion 13 of the bottom surface 12 and a bottom side of at least part of the second portion 14 of the bottom surface 12. The second chamber portion 30*b* is defined by side walls 33, the bottom side of at least part of the second portion 14 of the bottom surface 12, and the bottom wall 34.

The chamber 30 is disposed beneath the drain opening 16 such that a fluid held within basin 10 can flow through the drain opening 16 of the basin 10 and into the chamber 30 via the fluid inlet 31 of the chamber 30. The chamber 30 is oriented beneath the projection 15 such that view of the chamber 30 of a user of the lavatory system 1 is at least partially obscured by the projection 15. Although the chamber 30 is shown integrally formed with the basin 10, according to an additional aspect, the chamber 30 is detachably coupled to the basin 10.

The orientation of the chamber 30 relative to the basin 10, and the drain opening 16 of the basin 10 specifically, allows for a storage area 40 to be positioned beneath the chamber 30. The storage area 40 is configured to store items related to the use of the lavatory system 1. The shape and/or size of the storage area 40 is of any suitable shape and/or size allowed by the relative orientation, placement, and size of the basin 10 and the chamber 30.

As shown in FIGS. 1-3, the drainage assembly 50 includes a horizontally oriented channel 51, a vertically oriented channel 52, and an outlet channel 55. The drainage assembly 50 includes a fluid inlet 53 fluidly coupled to the fluid outlet 32 of the chamber 30. As shown in FIGS. 1 and 3, the fluid inlet 53 of the drainage assembly 50 is directly connected to the horizontally oriented channel 51. The drainage assembly 50 also includes fluid outlet 54 which is fluidly coupled to an external plumbing system (e.g., a plumbing system of a building) (not shown). The fluid inlet 53 of the drainage assembly 50 is configured to facilitate a fluid flow from the chamber 30 to the fluid outlet 54 of the drainage assembly 50 and thereby to the external plumbing system. The horizontally oriented channel 51, the vertically oriented channel 52, and the outlet channel 55 are made of any suitable material, for example, plastic or ceramic.

As shown in FIGS. 1-3, the drainage assembly 50 also includes a first connector 70, a second connector 80, and a waste 95. The first connector 70 (described in more detail below with reference to drainage assembly 250) and the second connector 80 (described in more detail below with reference to drainage assembly 250) are disposed between the vertically oriented channel 52 of the drainage assembly and the outlet channel 55 of the drainage assembly 50.

The lavatory system 1 also includes a pop-rod assembly 90. The pop-up rod assembly 90 is configured to control the fluid flow within the drainage assembly from the chamber 30 to the external plumbing system, in the manner as described in more detail below with reference to drainage assembly 250. The pop-up rod assembly 90 includes a handle 91 whereby a user can control movement of the components of the pop-up rod assembly 90. As shown in FIGS. 2-3, the pop-up rod assembly 90 also includes a first connecting rod 92 which is connected directly to the handle 91. The pop-up rod assembly 90 also includes a connecting rod 93 which is connected directly to the waste 95. The connecting rod 92 and the connecting rod 93 are connected via connector 94. By using the handle 91, a user can cause the connecting rod 92 to move vertically and thereby cause the connecting rod 93 to pivot vertically about the waste 95. By so moving the connecting rod 93, a fluid flow through the drainage assembly 50 can be controlled.

Referring now to FIGS. 7-10, a lavatory system 2 according to an exemplary embodiment is shown. The lavatory system 2 includes a basin 210. The basin 210 is configured to receive a fluid flow (such as a flow of water) from a fluid source, such as a faucet (not shown). The basin 210 is also configured to hold a volume of fluid within the basin 210. The basin 210 is formed of any suitable material, for example, a ceramic material.

Figure 7:
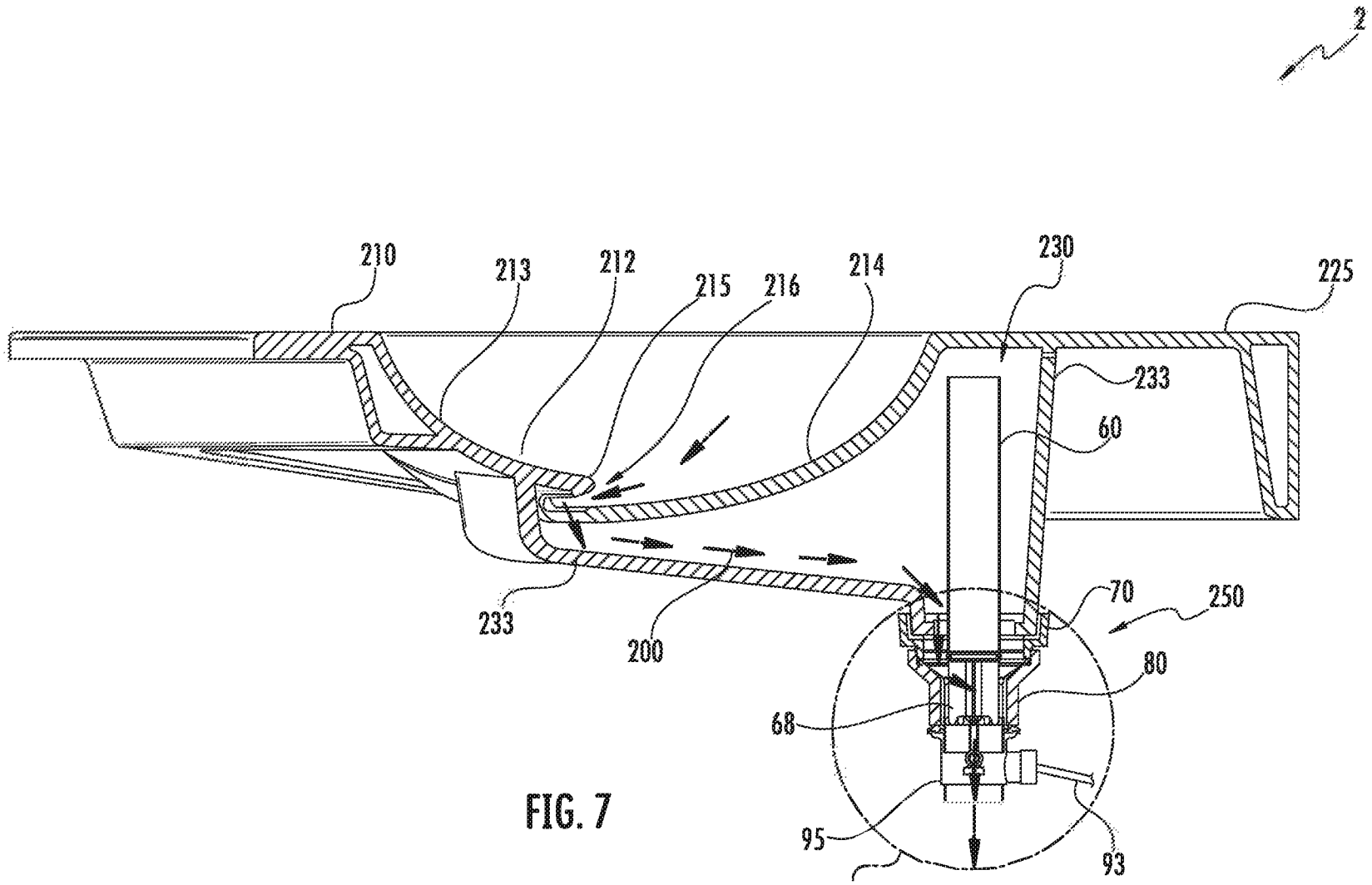
FIG. 7 is a side cross-sectional view of a lavatory system, including an overflow pipe in a first position, according to a second exemplary embodiment.
Figure 9:
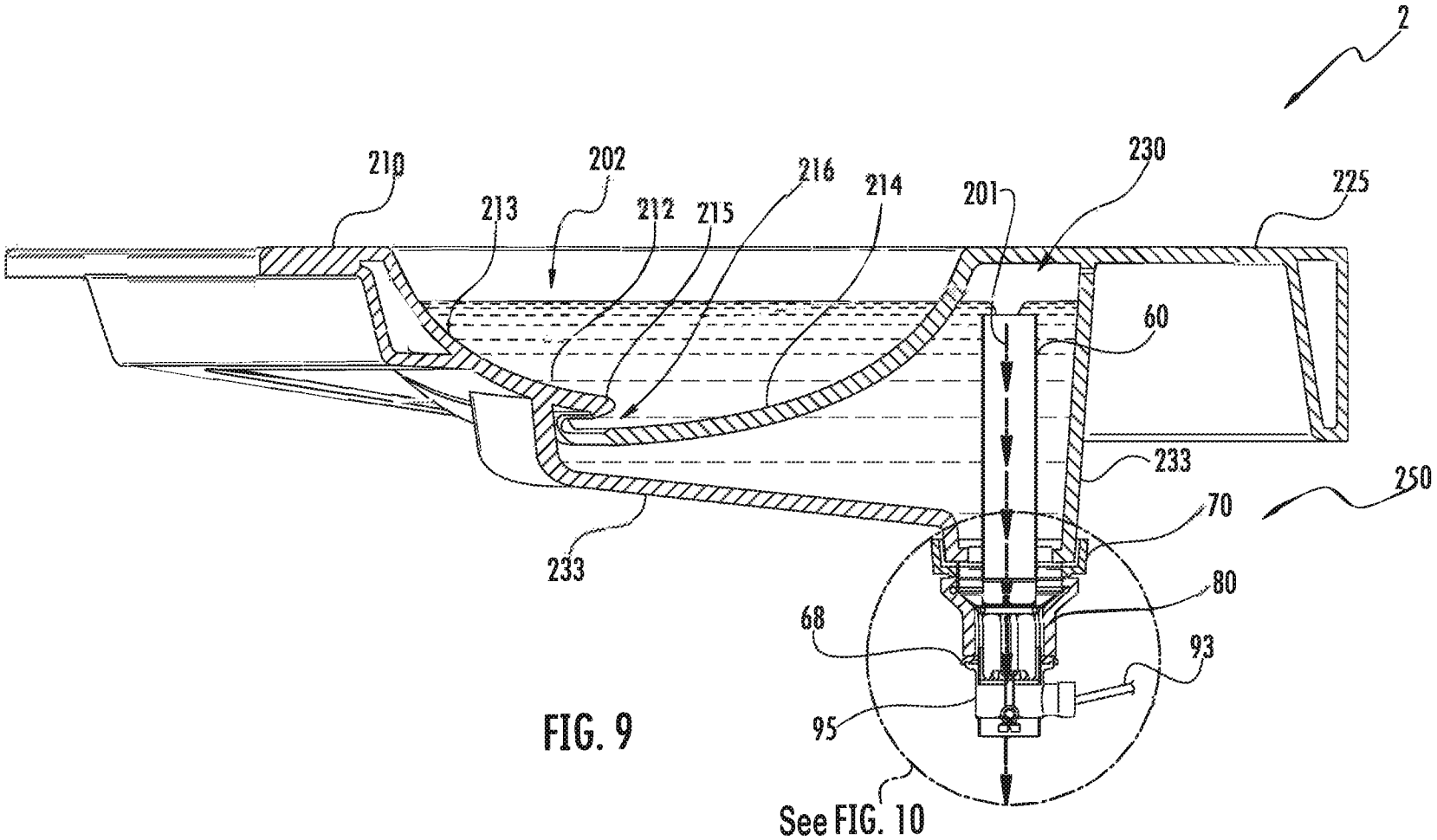
FIG. 9 is a side cross-sectional view of the lavatory system, including the overflow pipe in a second position, as shown in FIG. 7.

The basin 210 includes a bottom surface 212 including a first portion 213 and a second portion 214. The first portion 213 and the second portion 214 define a drain opening 216 which is configured to allow a fluid flow 200 out of the basin 210. The drain opening 216 is at least partially obscured from the view of a user by a projection or lip 215. According to one aspect of the lavatory system 2, the projection 215 entirely obscured from the view of the user the drain opening 216. As shown in FIGS. 7 and 9, the projection 215 is integrally formed with the first portion 213 of the bottom surface 212 of the basin 210. The lavatory system also includes basin support 225 which is configured to either independently or dependently support the basin 210.

The basin 210 also includes a chamber (e.g., hidden chamber) 230 which is fluidly coupled to the basin 210. The chamber 230 is defined by the second portion 214 of the bottom surface 212 of the basin 210 and walls 233, including side walls and a bottom wall. The chamber 230 is configured such that the fluid flow 200 from the basin 210 via the drain opening 216 is received into chamber 230.

The lavatory system 2 also includes a drainage assembly 250. The drainage assembly 250 includes an overflow pipe (e.g., channel) 60. The overflow pipe is configured to move from a first position (shown in FIG. 7), in which the fluid flow 200 flows out of the chamber 230 without first flowing through the overflow pipe 60, to a second position (shown in FIG. 9), in which the fluid flow 200 flows out of the chamber 230 via the overflow pipe 60. When the overflow pipe 60 is in the second position, the basin 210 is fillable with a volume of fluid (for example, water). The various components of the drainage assembly 250 described below are made of suitable materials, for example, plastic or ceramic.

Figure 11:
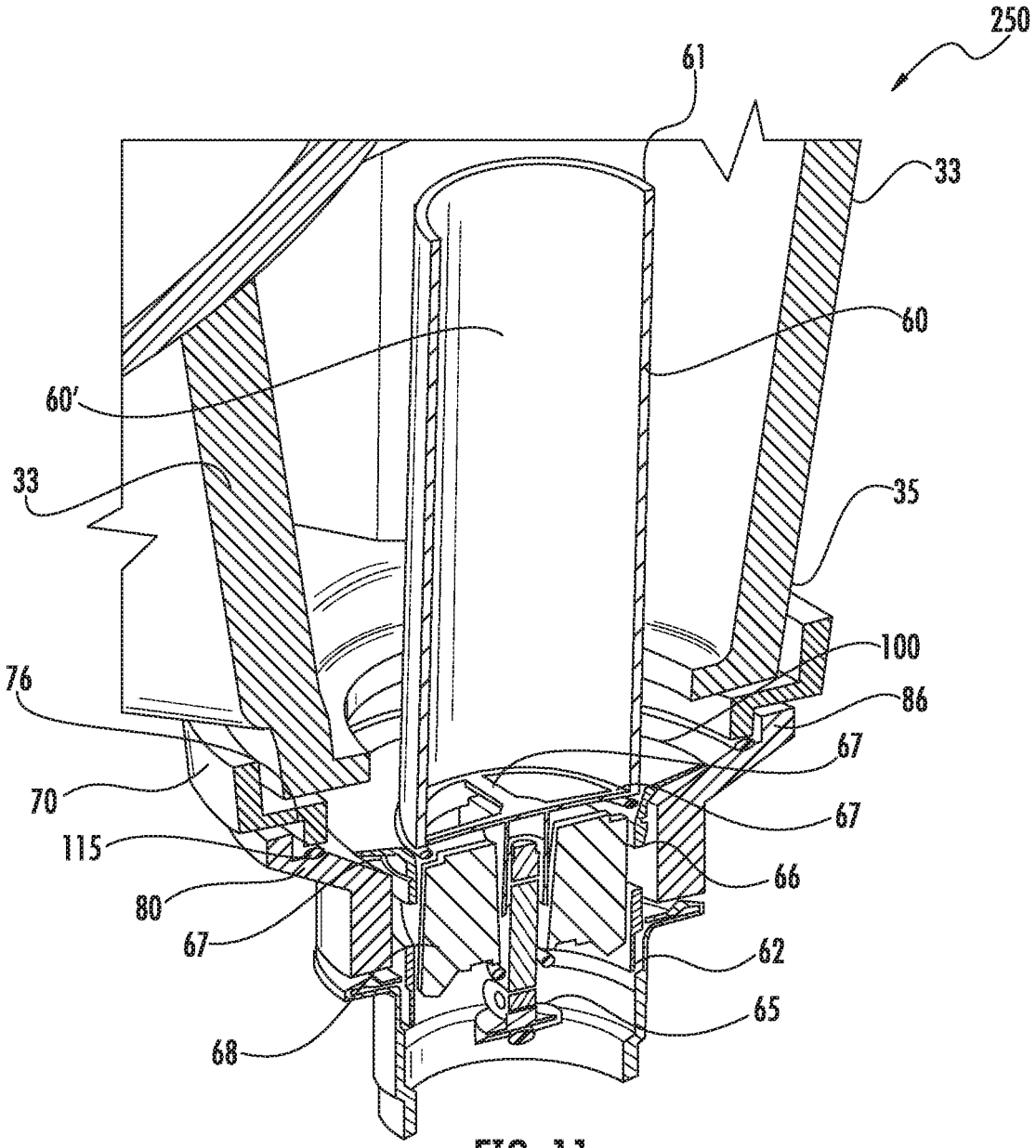
FIG. 11 is side perspective cross-sectional view of a drainage assembly useable with a lavatory system, according to a third exemplary embodiment.
Figure 12:
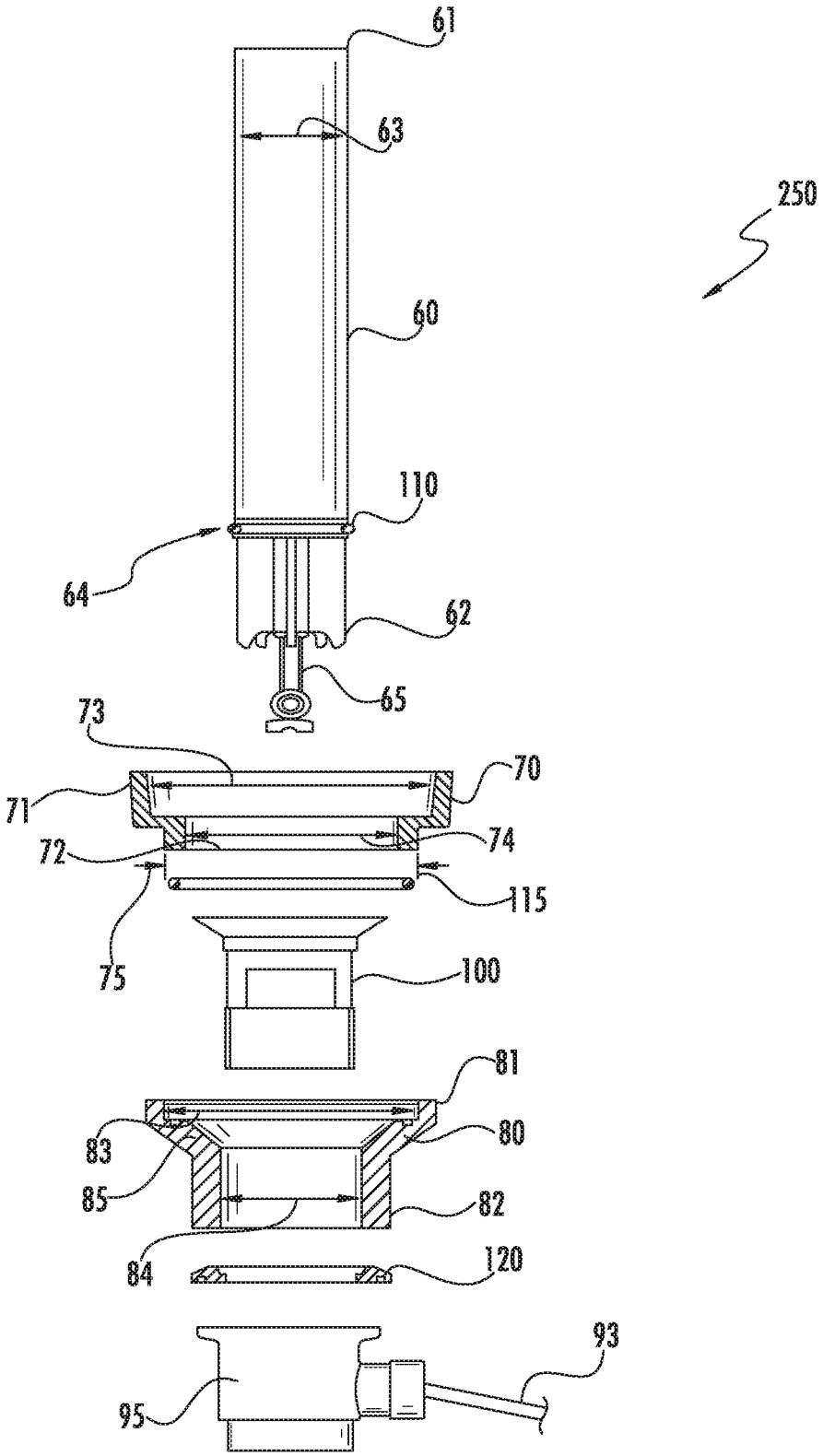
FIG. 12 is an exploded view of the drainage assembly shown in FIG. 11.

As can best be appreciated with reference to FIGS. 11-12, the overflow pipe 60 includes a first end 61, which is configured to be housed within the chamber 230, and a second end 62. The overflow pipe 60 also includes an inner surface 60' having an inner diameter 63. The overflow pipe 60 also includes a groove 64 on an outer surface of the overflow pipe 60 configured to house a sealing ring 110 (such as an O-ring) which is configured to seal a connection between the overflow pipe 60 and a first connector 70 and a second connector 80 (as shown in FIGS. 1-3 and as described below in more detail). Referring to FIGS. 11-12 and 14-17, the overflow pipe 60 also includes a sealing member 68. The overflow pipe 60 also includes a plurality of inner ribs 67 which are connected to the inner surface 60' of the overflow pipe 60 and which support sleeve 66 connected to the sealing member 68. The sealing member 68 is connected to the overflow pipe 60 by any suitable means. For example, the sealing member 68 is connected to the overflow pipe 60 via a screw (not shown) which is connected to an end of arm 65 (described below) and which is connectable to the plurality of inner ribs 67. As another example, the sealing member 68 is connected to the overflow pipe 60 via a snap-fit between the sealing member 68 and the plurality of inner ribs 67.

Sleeve 66 is configured to hold the arm 65 which extends beyond the end 62 of the overflow pipe 60 and is configured to be connected to connecting rod 93 of pop-up rod assembly 90 (described above). When the connecting rode 93 of the pop-up rod assembly 90 is moved, the arm 65 of the overflow pipe 60 is moved, thereby adjusting a position of the sealing member 68 of the overflow pipe 60 within the drainage assembly 250. When the sealing member 68 of the overflow pipe is in a first position, fluid flow 200 flows from the chamber 230 into the waste 95 of the drainage assembly 250 without flowing through the overflow pipe 60. When the sealing member 68 of the overflow pipe is in a second position, fluid flow 201 flows from the chamber 230 through the overflow pipe 60 into the waste 95.

Figure 8:
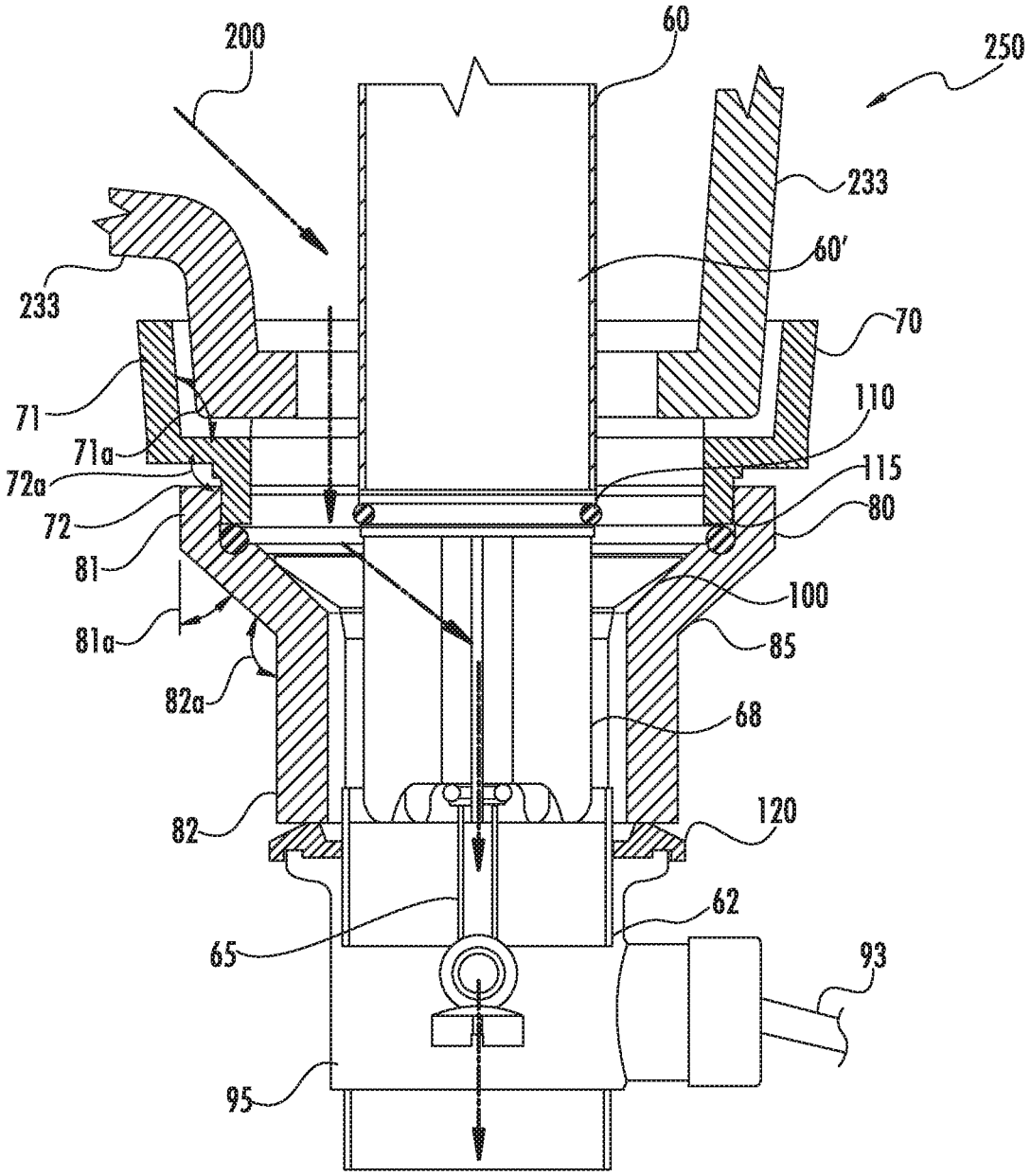
FIG. 8 is a detailed side cross-sectional view of the circled portion shown in FIG. 7.
Figure 10:
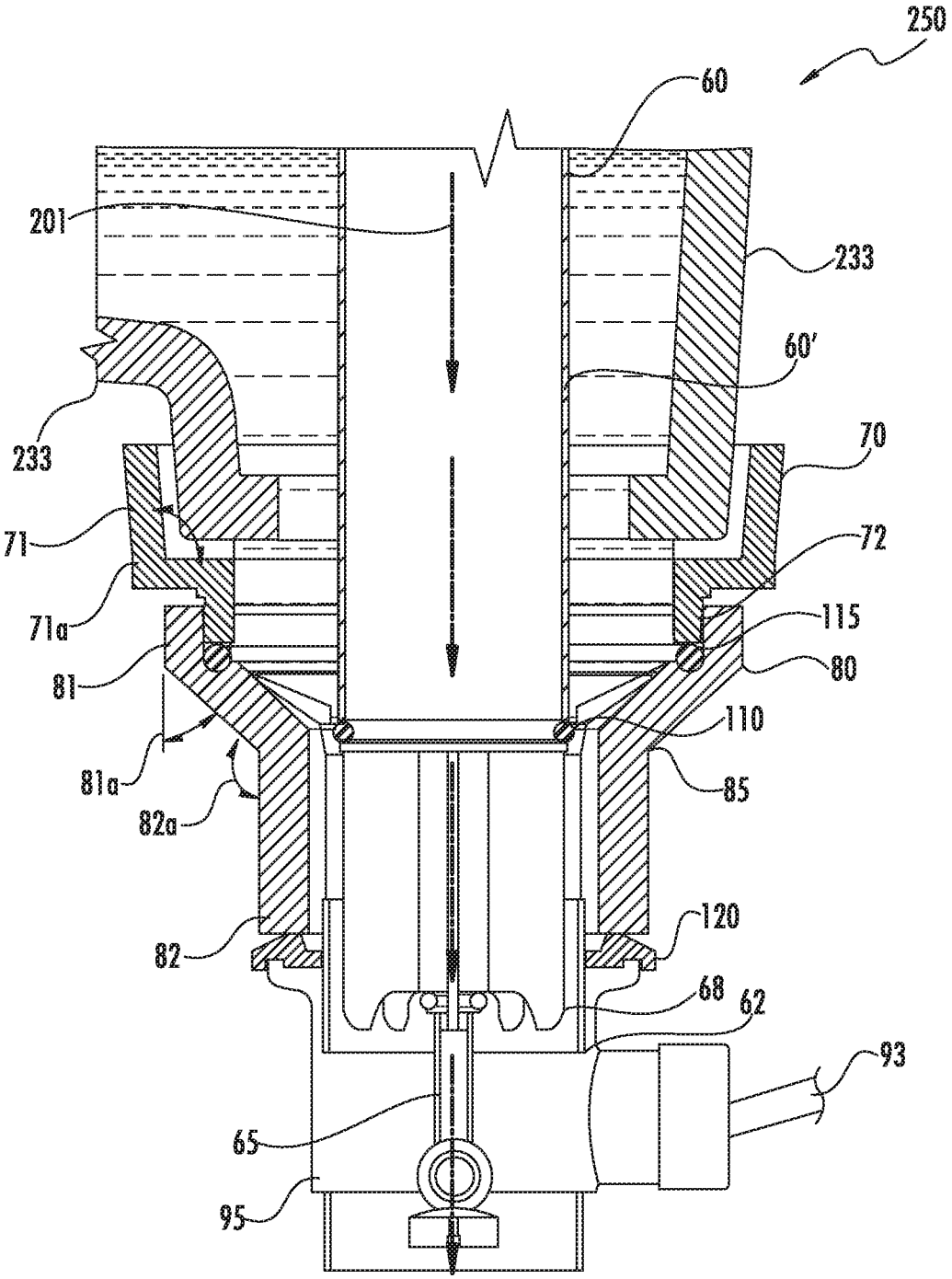
FIG. 10 is a detailed side cross-sectional view of the circled portion B shown in FIG. 9.

Referring still to FIGS. 11-12, the first connector 70 includes a first end portion 71 having an inner diameter 73. The first end portion 71 is configured to be attached to outlet 35 of chamber 30 (as shown in FIG. 11) or to a bottom portion of the chamber 230. As shown in FIGS. 8 and 10, the first end portion 71 includes a first portion and a second portion oriented at an angle 71*a* relative to each other. As shown in FIG. 12, the first connector 70 also includes a second end portion 72 having an inner diameter 74 and an outer diameter 75. The outer diameter 75 of the second end portion 72 may include thread 76, as shown in FIG. 11. As shown in FIG. 8, the second end portion 72 includes a first portion and a second portion oriented at an angle 72*a* relative to each other.

Referring to FIGS. 11-12, the second connector 80 is configured to be attached to the second end portion 72 of the first connector 70. The second connector 80 includes a first end portion 81 having an inner diameter 83 having thread 86. The inner diameter 83 of the first end portion 81 of the second connector 80 is larger than the outer diameter 72 of the second end portion 72 of the first connector 70. The thread 86 of the first end portion 81 of the second connector 80 is configured to mate with the thread 76 of the second end portion 72 of the first connector 70. The second connector 80 also includes a second end portion 82 which includes an inner diameter 84 which is configured to be connected to a waste 95. The second end portion 82 is also configured to receive a sealing ring 120 which is configured to seal a connection between the second end portion 82 of the second connector 80 and the waste 95.

The second connector 80 also includes a middle portion 85 disposed between the first end portion 81 and the second end portion 82. The first end portion 81 and the middle portion 85 are oriented at an angle 81*a* relative to each other. The second end portion 82 and the middle portion 85 are oriented at an angle 82*a* relative to each other. The middle portion 85 is configured such that a sealing ring 115 sits in the first end portion 81 and against the middle portion 85 such that the sealing ring 115 is held in place. The middle portion 85 is also configured to house and hold a waste 100 within the second connector 80.

Figure 13C:
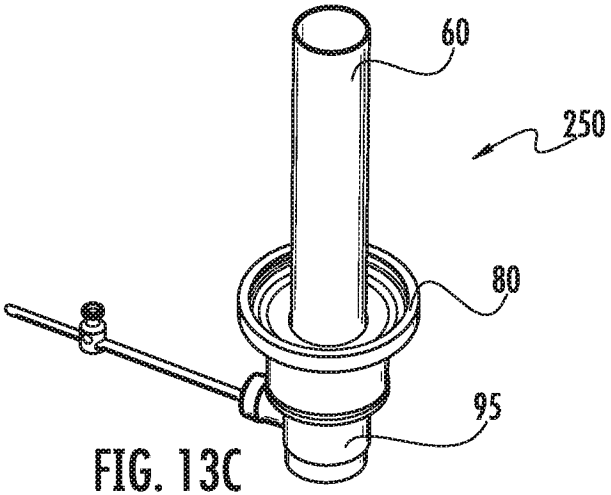
Figure 13D:
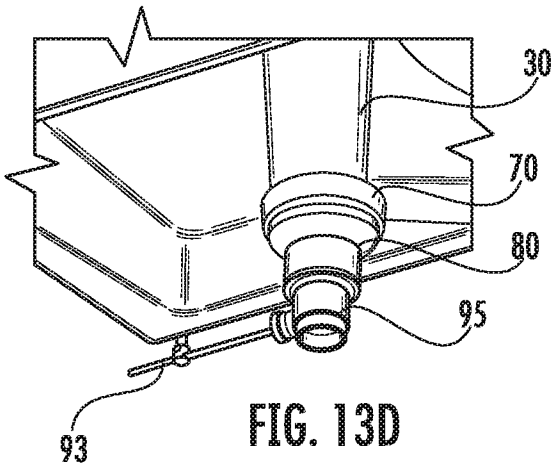
Figure 13A:
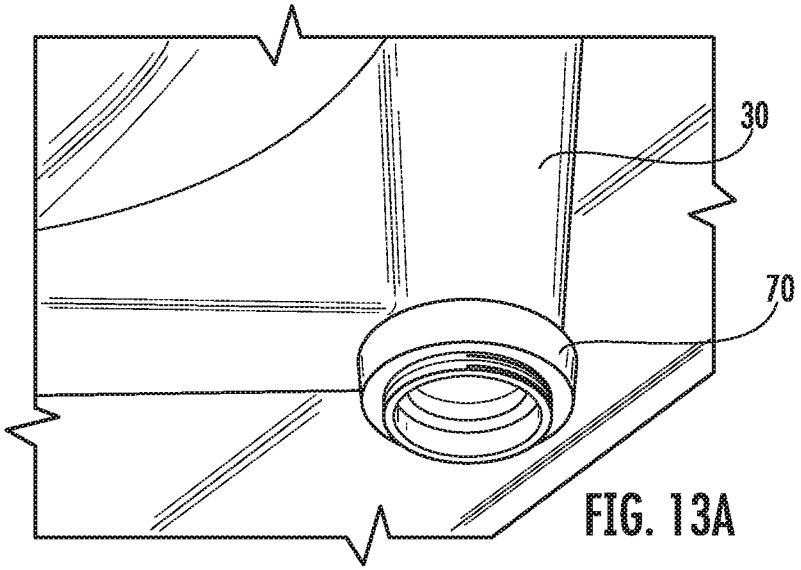
Figure 13B:
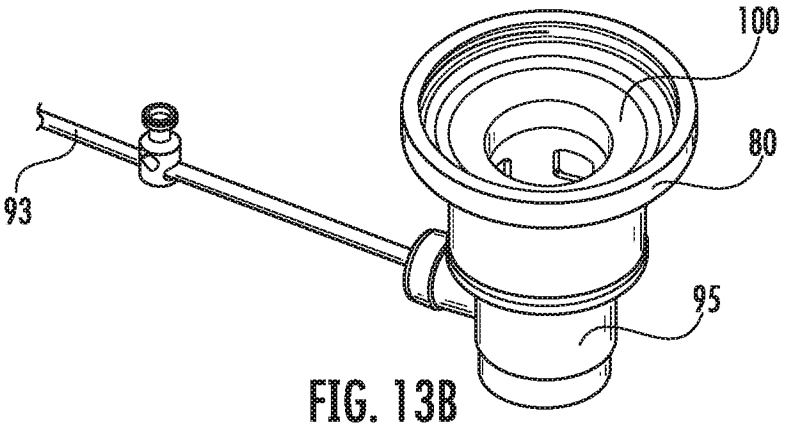
Figure 14:
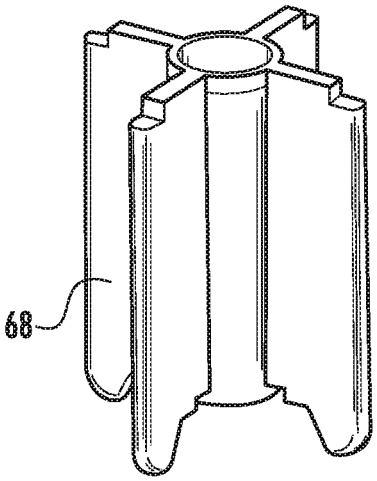
FIGS. 14-15 are perspective views of a sealing member of the drainage assembly of FIG. 11.
Figure 15:
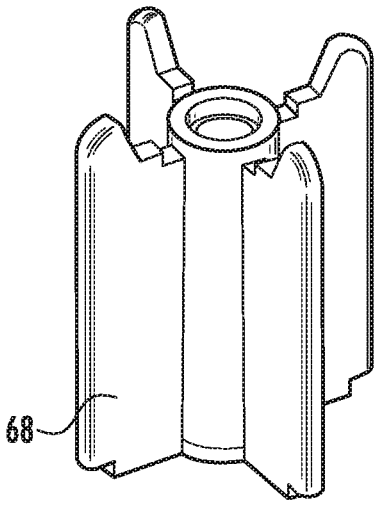
Figure 16:
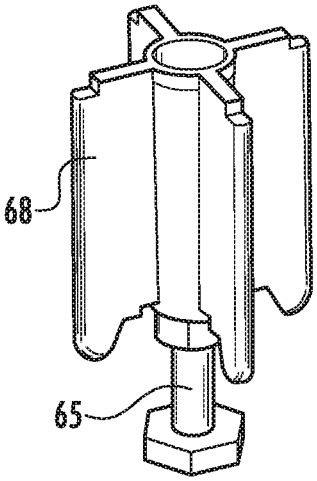
FIG. 16 is a perspective view of the sealing member of FIG. 11 including an arm coupled thereto.
Figure 17:
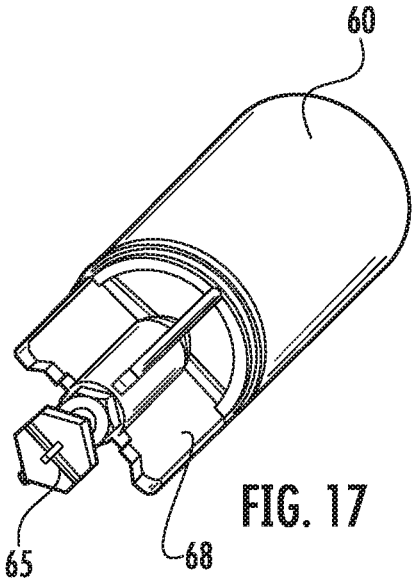
FIG. 17 is a perspective view of the sealing member and arm of FIG. 16 coupled to an overflow pipe of the drainage assembly of FIG. 11.

FIGS. 13A-D illustrate a method of assembling the drainage assembly 250 onto a chamber 30 or chamber 230 described above. As shown in FIG. 13A, the first connector 70 is affixed to the chamber 30, for example, by using an adhesive. As shown in FIG. 13B, a connecting rod 93 of a pop-up rod assembly is connected to the waste 95. The waste 95 is the affixed to the second connector 80 and the waste 100 is placed inside the second connector 80. As shown in FIG. 13C, the drainage assembly 250 is assembled by inserting the overflow pipe 60 into the second connector 80 and thereby secured to the waste 95. As shown in FIG. 13D, the second connector 80 is affixed (for example, by using an adhesive) to the first connector 70, completing the assembly of the drainage assembly 250 and securably attaching the drainage assembly 250 to the chamber 30 or chamber 230 of a lavatory system.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the lavatory system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, any element (e.g., the overflow pipe, connector, hidden chamber, etc.) disclosed in one embodiment may be incorporated or utilized with any other embodiment disclosed herein.

What is claimed is:

1. A lavatory comprising:

a basin comprising a bottom surface, the basin configured to hold a volume of water;

a drain opening disposed in the bottom surface of the basin; and a drain assembly comprising:

a pipe moveable from a first position to a second position;

a first connector comprising a first end portion comprising an inner diameter and a second end portion comprising an inner diameter and an outer diameter; and a second connector comprising a first end portion comprising an inner diameter configured to fit over and around the outer diameter of the second end portion of the first connector, wherein in the first position an end of the pipe is configured to be housed within an inner surface of the first connector and in the second position the end of the pipe is configured to be housed within an inner surface of the second connector, wherein the bottom surface of the basin comprises a horizontally extending projection formed integrally with the bottom surface of the basin, wherein the horizontally extending projection is disposed over the drain opening such that the drain opening is at least partially obscured from a view of a user, wherein the basin further comprises a chamber disposed beneath and in fluid communication with the drain opening, wherein the chamber is configured to receive a first fluid flow from the drain opening and provide a second fluid flow to a waste, wherein the chamber is configured to house at least a portion of the pipe, the pipe in fluid communication with the waste, and wherein the first end portion of the first connector is configured to be connected to the fluid outlet of the chamber.

2. The lavatory according to claim 1, further comprising:

a connecting rod connected to the overflow pipe and extending at least partially from the overflow pipe; and a pop-up rod assembly connected to the connecting rod, the pop-up rod assembly being configured to control a movement of the overflow pipe.

3. The lavatory according to claim 1, wherein the first connector is configured to be fluidly sealed to a fluid outlet of the chamber.

4. The lavatory according to claim 3, wherein the second connector is configured to be fluidly sealed to the first connector and further configured to be connected to the waste.

5. A lavatory system comprising:

a basin configured to hold a volume of water, the basin comprising:

a bottom surface; and a drain opening disposed in the bottom surface of the basin; and a hidden chamber disposed beneath the basin, the hidden chamber comprising a fluid inlet, and a fluid outlet, the hidden chamber configured to receive a fluid flow from the drain opening of the basin; and a drain assembly comprising:

an overflow pipe comprising a first end and a second end, the overflow pipe being moveable from a first position to a second position;

a waste in fluid communication with the fluid outlet of the hidden chamber;

a first connector comprising a first end portion comprising an inner diameter and a second end portion comprising an inner diameter and an outer diameter; and a second connector comprising a first end portion comprising an inner diameter configured to fit over and around the outer diameter of the second end portion of the first connector, wherein the first end portion of the first connector is configured to be connected to the fluid outlet of the hidden chamber, wherein in the first position an end of the overflow pipe is configured to be housed within an inner surface of the first connector and in the second position the end of the overflow pipe is configured to be housed within an inner surface of the second connector, and wherein in the first position of the overflow pipe, fluid flows from the hidden chamber into the waste without flowing through the overflow pipe, and in the second position of the overflow pipe, fluid flow flows from the hidden chamber into the waste via the overflow pipe.

6. The lavatory system according to claim 5, wherein the basin is configured to hold a volume of water when the overflow pipe is in the second position.

7. The lavatory system according to claim 5, wherein the bottom surface of the basin comprises a horizontally extending projection formed integrally with the bottom surface of the basin, and wherein the horizontally extending projection is disposed over the drain opening such that the drain opening is at least partially obscured from a view of a user.

8. The lavatory system according to claim 5, wherein the first end of the overflow pipe is housed within the hidden chamber.

9. The lavatory system according to claim 5, further comprising a connecting rod connected to the overflow pipe and extending at least partially from the second end of the overflow pipe.

10. The lavatory system according to claim 9, further comprising a pop-up rod assembly connected to the connecting rod, the pop-up rod assembly being configured to control a movement of the overflow pipe from the first position to the second position.

11. A lavatory system comprising:

a basin configured to hold a volume of water, the basin comprising a bottom surface; and a drain opening disposed in the bottom surface of the basin;

a hidden chamber disposed beneath the basin, the hidden chamber comprising a fluid inlet and a fluid outlet and configured to receive a fluid flow from the drain opening of the basin; and a drain assembly comprising:

a pipe configured to receive the fluid flow, the pipe being moveable from a first position to a second position;

a first connector comprising a first end portion comprising an inner diameter and a second end portion comprising an inner diameter and an outer diameter; and a second connector comprising a first end portion comprising an inner diameter configured to fit over and around the outer diameter of the second end portion of the first connector and a second end portion configured to be connected to a first waste, wherein the first end portion of the first connector is configured to be connected to the fluid outlet, and wherein in the first position an end of the pipe is configured to be housed within an inner surface of the first connector and in the second position the end of the pipe is configured to be housed within an inner surface of the second connector.

12. The lavatory system according to claim 11, wherein in the first position of the pipe, the drain assembly is configured to allow a fluid flow from the drain opening into the first waste without flowing through the pipe, and wherein in the second position, the drain assembly is configured to allow a fluid flow from the drain opening into the first waste via the pipe.

13. The lavatory system according to claim 11, wherein the outer diameter of the second end portion of the first connector comprises a thread and the inner diameter of the first end portion of the second connector comprises a thread configured to mate with the thread of the outer diameter of the second end portion of the first connector.

14. The lavatory system according to claim 11, further comprising a second waste configured to be housed within an inner surface of the second connector.

15. The lavatory system according to claim 11, wherein at least a portion of the pipe is configured to be housed in the hidden chamber.

16. The lavatory system according to claim 11, wherein the first waste is connectable to an external plumbing system.

17. The lavatory system according to claim 11, further comprising a pop-up rod assembly;

wherein the pipe includes a connecting rod connected to the pipe, the connecting rod being configured to be connected to the pop-up rod assembly.

18. The lavatory system according to claim 17, wherein the pop-up rod assembly is configured to control a movement of the pipe between the first position and the second position.

* * * * *